US009988939B2

(12) United States Patent
Ishii

(10) Patent No.: US 9,988,939 B2
(45) Date of Patent: Jun. 5, 2018

(54) FIXED VANE-TYPE TURBOCHARGER

(75) Inventor: Mikito Ishii, Yokosuka (JP)

(73) Assignee: IHI CORPORATION (JP)

( * ) Notice: Subject to any disclaimer, the term of this patent is extended or adjusted under 35 U.S.C. 154(b) by 784 days.

(21) Appl. No.: 13/821,646

(22) PCT Filed: Sep. 12, 2011

(86) PCT No.: PCT/JP2011/070731
§ 371 (c)(1),
(2), (4) Date: Mar. 8, 2013

(87) PCT Pub. No.: WO2012/036122
PCT Pub. Date: Mar. 22, 2012

(65) Prior Publication Data

US 2013/0170975 A1 Jul. 4, 2013

(30) Foreign Application Priority Data

Sep. 13, 2010 (JP) ..... 2010-204533

(51) Int. Cl.
*F01D 25/24* (2006.01)
*F01D 9/04* (2006.01)
(Continued)

(52) U.S. Cl.
CPC ..... *F01D 25/24* (2013.01); *F01D 9/045* (2013.01); *F01D 25/125* (2013.01); *F02B 37/24* (2013.01);
(Continued)

(58) Field of Classification Search
CPC ..... F01D 25/125; F01D 25/24; F01D 9/045; F02B 37/24; F05D 2220/40; F05D 2230/642; F05D 2240/12; F05D 2260/38
See application file for complete search history.

(56) References Cited

U.S. PATENT DOCUMENTS 2,976,013 A 3/1961 Hunter
3,112,096 A * 11/1963 Lazo ..... F01D 9/045 415/135
(Continued)

FOREIGN PATENT DOCUMENTS

CN 1952361 A 4/2007
DE 10 2008 000 724 A1 9/2009
(Continued)

OTHER PUBLICATIONS

Machine Translation of JPH 0652048.*
(Continued)

*Primary Examiner* — Brandon Lee
(74) *Attorney, Agent, or Firm* — Ostrolenk Faber LLP

(57) ABSTRACT

A fixed vane-type turbocharger is provided with a fixed vane in a conduit between a bearing housing and a turbine housing. The fixed vane is configured by a movable member disposed on one of the mutually opposing front faces of the bearing housing and the turbine housing so as to be capable of forward and backward movement, and by vanes which are fixed to the front face of the movable member. A pressing member presses the movable member so that the distal ends of the vanes are brought into pressure contact between the rear face of the movable member and either the bearing housing or the turbine housing with the other opposing front face of these. The pressing member contacts the rear face of the movable member within a range in the radial direction where the vanes are disposed, and presses within this range.

6 Claims, 6 Drawing Sheets

(51) Int. Cl.
*F01D 25/12* (2006.01)
*F02B 37/24* (2006.01)

(52) U.S. Cl.
CPC .... *F05D 2220/40* (2013.01); *F05D 2230/642* (2013.01); *F05D 2240/12* (2013.01); *F05D 2260/38* (2013.01)

(56) References Cited

U.S. PATENT DOCUMENTS

| | | | | |
|---|---|---|---|---|
| 8,568,092 | B2 * | 10/2013 | Matsuyama | F01D 11/005 415/173.3 |
| 2011/0038742 | A1 * | 2/2011 | Fleig | F01D 17/165 417/406 |

FOREIGN PATENT DOCUMENTS

| | | | |
|---|---|---|---|
| JP | 61-085503 | | 5/1986 |
| JP | 61085503 | A * | 5/1986 |
| JP | 63-150423 | | 6/1988 |
| JP | 5-071498 | | 3/1993 |
| JP | H 0652048 | * | 6/1994 |
| JP | 9-268902 | | 10/1997 |
| JP | 2001-329996 | | 11/2001 |
| JP | 2003-184563 | | 7/2003 |
| JP | 2005-042588 | | 2/2005 |
| JP | 2005-163783 | | 6/2005 |
| JP | 2006-125588 | | 5/2006 |
| JP | 2007-192124 | | 8/2007 |
| JP | 2009-144546 | | 7/2009 |
| JP | 2009-524773 | | 7/2009 |
| WO | WO 2004/048755 | | 6/2004 |
| WO | WO 2009092678 | A1 * | 7/2009 |
| WO | WO 2011/152454 | A1 | 12/2011 |

OTHER PUBLICATIONS

Chinese Office Action, dated Jun. 26, 2014, issued in corresponding Chinese Patent Application No. 201180043625.0. English translation of Search Report. Total 9 pages.

International Search Report and Written Opinion mailed Oct. 4, 2011 in corresponding PCT International Application No. PCT/JP2011/070731.

International Search Report mailed Jul. 12, 2011 in related PCT International Application No. PCT/JP2011/062598, with English translation.

* cited by examiner

FIXED VANE-TYPE TURBOCHARGER

CROSS-REFERENCE TO RELATED APPLICATIONS

The present application is a 35 U.S.C. §§ 371 national phase conversion of PCT/JP2011/070731, filed Sep. 12, 2011, which claims priority of Japanese Patent Application No. 2010-204533, filed Sep. 13, 2010, the contents of which are incorporated herein by reference. The PCT International Application was published in the Japanese language.

TECHNICAL FIELD

The present invention relates to a fixed vane-type turbocharger that enhances the rectification effect from a fixed vane by a simple configuration.

BACKGROUND ART

It is known that turbochargers have previously been provided in internal combustion engines of automobiles or the like for purposes of achieving enhanced output. A turbocharger has a turbine scroll into which the exhaust of an internal combustion engine is fed, a turbine impeller which is rotated by supplying the exhaust (fluid) in the turbine scroll via a conduit, a compressor impeller which is integrally rotated with the turbine impeller, and a compressor scroll as a diffuser which is supplied with the air (fluid) from the compressor impeller via a conduit, wherein the pressurized air from the compressor scroll is forcibly supplied to a combustion chamber of the internal combustion engine.

For purposes of rectifying the flow of fluid, vanes may be provided in either or both of the conduit through which exhaust flows on the aforementioned turbine side and the conduit through which air flows on the compressor side.

The vanes provided in the conduit on the turbine side are described as follows. With respect to the exhaust which is fed to the turbine impeller and whose flow rate is increased by the turbine scroll formed in the turbine housing, there is uniform inflow from the periphery of the turbine impeller due to vanes, achieving enhanced turbine efficiency. With respect to such vanes, there is known to be a fixed vane-type in which the vanes are fixed to one of the mutually opposing front faces of the turbine housing or the bearing housing, and a variable vane-type in which shafts provided in the respective vanes between the aforementioned mutually opposing front faces of the turbine housing and the bearing housing are provided so as to be simultaneously rotated by a link mechanism or the like, changing the angles of the vanes in unison.

With the fixed vane-type, since the exhaust inflow angle is fixed, it is impossible to vary the exhaust flow rate according to the rotational frequency or the like of the internal combustion engine. In contrast, with the variable vane-type, the exhaust flow rate can be varied by changing the exhaust inflow angle according to the rotational frequency or the like of the internal combustion engine. On the other hand, in contrast to the relatively simple configuration of the fixed vane-type, the variable vane-type has a complex configuration, because it has moving parts.

Furthermore, there is the problem that an interstice called a vane side clearance arises with respect to the vanes that are provided between the aforementioned mutually opposed front faces of the turbine housing and the bearing housing. That is, even if the clearance between the vanes and the opposing turbine housing or bearing housing is designed to be zero, it is extremely difficult to actually keep the clearance at zero, because the turbine housing that has a complex form experiences uneven thermal deformation during operation, and deformation also occurs due to differences in thermal expansion from the different materials of the vanes and the bearing housing to which the vanes are fixed.

Here, in contrast to the variable vane-type where it is necessary to provide a given side clearance on both sides of the vanes due to the moving parts, a side clearance only occurs on one side of the vanes in the fixed vane-type.

With respect also to vanes provided in the conduit on the compressor side, a side clearance similarly arises, even though the temperature is lower compared to the turbine.

As prior art reference information for such turbochargers in relation to the present invention, for example, there is a case in which both fixed vanes and variable vanes are provided (see Patent Document 1 and the like). In addition, there is also a case pertaining to variable vanes where the vanes are interposed in a turnable manner between a rear exhaust inlet wall and a front exhaust inlet wall, wherein side clearance between the rear exhaust inlet wall side and the vanes is reduced by providing a pressing means between the respective vane shafts and the bearing housing which presses the respective shafts toward the rear exhaust inlet wall side, causing displacement of the vanes toward the rear exhaust inlet wall side (see Patent Document 2 and the like).

PRIOR ART DOCUMENTS

Patent Documents

Patent Document 1: Japanese Unexamined Patent Application, First Publication No. 2007-192124

Patent Document 1: Japanese Unexamined Patent Application, First Publication No. 2009-144546

DISCLOSURE OF INVENTION

Problems that the Invention is to Solve

However, particularly with respect to the fixed vane-type turbocharger, there is the problem of the aforementioned side clearance. That is, for example, even if fabrication is conducted with highly precise height measurements in the axial direction of the vanes so that the side clearance of vanes provided in a conduit on the turbine side is zero, the side clearance cannot be kept at zero at the assembly stage. Consequently, exhaust from the turbine scroll leaks out through the side clearance of the vanes provided in the conduit on the turbine side, whereupon not only does this leaked exhaust not contribute to the effect of raising the exhaust flow rate by the vanes, but it also produces disturbance in the exhaust that is directed to the turbine impeller, greatly reducing turbine efficiency. Therefore, if the side clearance of vanes provided in the conduit on the turbine side could be kept at zero, it would be very effective in terms of raising turbine efficiency.

Moreover, even if fabrication is conducted with a high degree of dimensional accuracy with respect to the height of the vanes so that the side clearance of vanes provided in a conduit on the compressor side is zero, as in the case concerning the turbine side, clearance cannot be kept at zero at the assembly stage. Consequently, air from the compressor impeller leaks out through the side clearance, whereupon not only does this leaked air not contribute to a pressure-raising effect by the diffuser, but it also produces disturbance in the air that is directed to the compressor scroll, impairing the diffuser function. Therefore, if the side clearance of vanes provided in the conduit on the compressor side could be kept at zero, it would be very effective in terms of enhancing the diffuser function.

It would be conceivable in a state of use to press with a pressing means against the fixed vane-type vanes, and cause pressure contact with the front face of a member opposing the vanes to keep the side clearance of the vanes at zero.

However, depending on the manner in which pressing occurs against the vanes, the vanes may be pressed unevenly, with the result that a moment would be imposed on the vanes, bringing the vanes into pressure contact with the front face of the opposing member in a tilted state. When vanes are brought into pressure contact in a tilted state, a clearance arises between the front faces of the vanes and the opposing front face, with the result that it is impossible to keep clearance at zero.

In the case where, for example, a fixed vane is configured in a state where the vanes are integrally held in a movable member, and the vanes are pressed with interposition of the movable member, as the vanes are provided in a conduit on the turbine side, when the thermal effects of the high-temperature turbine are sustained, deformation may occur by pressing the movable member unevenly.

The present invention was made in light of the foregoing circumstances, and its object is to offer a fixed vane-type turbocharger which enhances the rectification effect from a fixed vane by a simple configuration, and which more reliably enables the side clearance of vanes to be kept at zero.

Means for Solving the Problems

The fixed vane-type turbocharger of the present invention is such that a conduit between a bearing housing and a turbine housing and a conduit between a bearing housing and a compressor housing are respectively formed by a first member and a second member that are in anteroposterior opposition, and at least one of the aforementioned conduits is provided with a fixed vane;

wherein the aforementioned fixed vane is configured by a movable member which is disposed on one of the mutually opposing front faces of the aforementioned first member and the aforementioned second member so as to be capable of forward and backward movement, and vanes which are fixed to the front face of the movable member;

a pressing means is provided between the rear face of the aforementioned movable member and the front face of either the aforementioned first member or the aforementioned second member, and presses the aforementioned movable member so that the distal ends of the aforementioned vanes are brought into pressure contact with the other front face of the aforementioned first member or the aforementioned second member;

and the aforementioned pressing means is configured to contact the rear face of the aforementioned movable member within a range in the radial direction where the aforementioned vane is disposed, and to conduct pressing within this range.

Or the fixed vane-type turbocharger of the present invention is such that a conduit between a bearing housing and a turbine housing and a conduit between a bearing housing and a compressor housing are respectively formed by a first member and a second member that are in anteroposterior opposition, and at least one of the aforementioned conduits is provided with a fixed vane;

a movable member is provided which is disposed on one of the mutually opposing front faces of the aforementioned first member and the aforementioned second member so as to be capable of forward and backward movement;

the aforementioned fixed vane is provided with vanes which are fixed to the other front face of the aforementioned first member or the aforementioned second member that is opposite the aforementioned movable member;

a pressing means is provided between the rear face of the aforementioned movable member and the front face of either the aforementioned first member or the aforementioned second member, and presses the aforementioned movable member so that the distal ends of the aforementioned vanes are brought into pressure contact with the front face of the aforementioned movable member;

and the aforementioned pressing means is configured to contact the rear face of the aforementioned movable member within a range in the radial direction where the aforementioned vanes are disposed, and to conduct pressing within this range.

According to this fixed vane-type turbocharger, the side clearance of the fixed vane is zero, because the movable member is pressed by a pressing means so that the distal ends of the vanes comes into pressure contact with the movable member or the other front face of the first member or second member.

Even if there is an incipient change in the side clearance of the fixed vane due to thermal deformation of the housing or due to differences in thermal expansion between the housing and the fixed vane during heating by turbocharger operation, the side clearance is constantly held at zero due to the concomitant forward-and-backward movement of the fixed vane.

Furthermore, as the pressing means which presses the movable member is configured to contact the rear face of the aforementioned movable member within a range in the radial direction where the vanes are disposed, and to conduct pressing within this range, the vanes are not pressed unevenly, thereby preventing the vanes from coming into pressure contact with the front face of the opposing member in a tilted state.

In the aforementioned fixed vane-type turbocharger, the aforementioned pressing means may be configured to conduct pressing on the inner side from the center in the radial direction within a range in the radial direction where the aforementioned vanes are disposed.

If this is done, even if the vanes come into pressure contact with the front face of the opposing member in a somewhat tilted state, and even if clearance forms between the vanes and the front face of the opposing member, the clearance is formed on the outer side in the radial direction, because pressing by the pressing means occurs on the inner side from the center in the radial direction. As the speed of fluid (exhaust or air) is slower in the conduit on the outer side in the radial direction than on the inner side in the radial direction, the amount of fluid leakage from the clearance is reduced, and the reduction in turbine efficiency is minimized.

With respect to the aforementioned fixed vane-type turbocharger, the aforementioned pressing means is preferably a disk spring which seals off fluid leakage to the rear side of the movable member.

If this is done, in addition to pressing the vanes, it is also possible to prevent leakage of fluid (exhaust or air) to the rear side the movable member.

Here, in the case where the aforementioned first member and second member are constituted by the aforementioned bearing housing and turbine housing, and where a water-cooling jacket for cooling is provided inside the aforementioned bearing housing, it is acceptable to have the inner peripheral edge of the aforementioned disk spring and the front face of the aforementioned bearing housing come into contact more toward the interior of the aforementioned bearing housing in the radial direction than the site where the aforementioned water-cooling jacket is formed.

If this is done, cooling of the disk spring by the action of the water-cooling jacket is facilitated, and functional impairment of the disk spring due to heat is prevented.

With respect to the aforementioned fixed vane-type turbocharger, the aforementioned movable member preferably consists of a heat shield plate in the case where the aforementioned first member and second member are constituted by the aforementioned bearing housing and turbine housing, and where the aforementioned movable member is provided on the opposing front face of the aforementioned bearing housing opposite the aforementioned turbine housing.

If this is done, the movable member doubles as the heat shield plate, with the result that heat propagation from the turbine housing to the bearing housing can be inhibited by this movable member.

Effects of the Invention

With the fixed vane-type turbocharger of the present invention, the side clearance of the fixed vane is kept at zero by pressing a movable member by a pressing means. Consequently, it is possible to achieve either or both of enhancement of turbine efficiency and enhancement of the diffuser function by the fixed vane, and raise the supercharging efficiency of the turbocharger.

As the side clearance is constantly held at zero even during heating by turbocharger operation, in contrast to the previous situation where measurement accuracy in the height dimension of the fixed vane had to be sufficiently raised in order to keep the side clearance at zero, the side clearance can be easily kept at zero with the present invention even if there is, for example, ordinary accuracy with respect to measurement accuracy in the height dimension of the fixed vane.

Furthermore, as the pressing means does not press the vanes unevenly, the vanes are thereby prevented from coming into pressure contact with the front face of the opposing member in a tilted state, enabling the side clearance to be reliably kept at zero.

When the pressing means presses the vanes with interposition of a movable member, as the vanes are not pressed unevenly as stated above, the movable member that sustains thermal effects from the high-temperature turbine can be prevented from becoming deformed by the pressing.

EMBODIMENTS FOR CARRYING OUT THE INVENTION

The fixed vane-type turbocharger of the present invention is described in detail below with reference to drawings. In the respective drawings used for the following description, the scale of various components has been suitably modified in order to render the respective components in an easily recognizable size.

Figure 1:
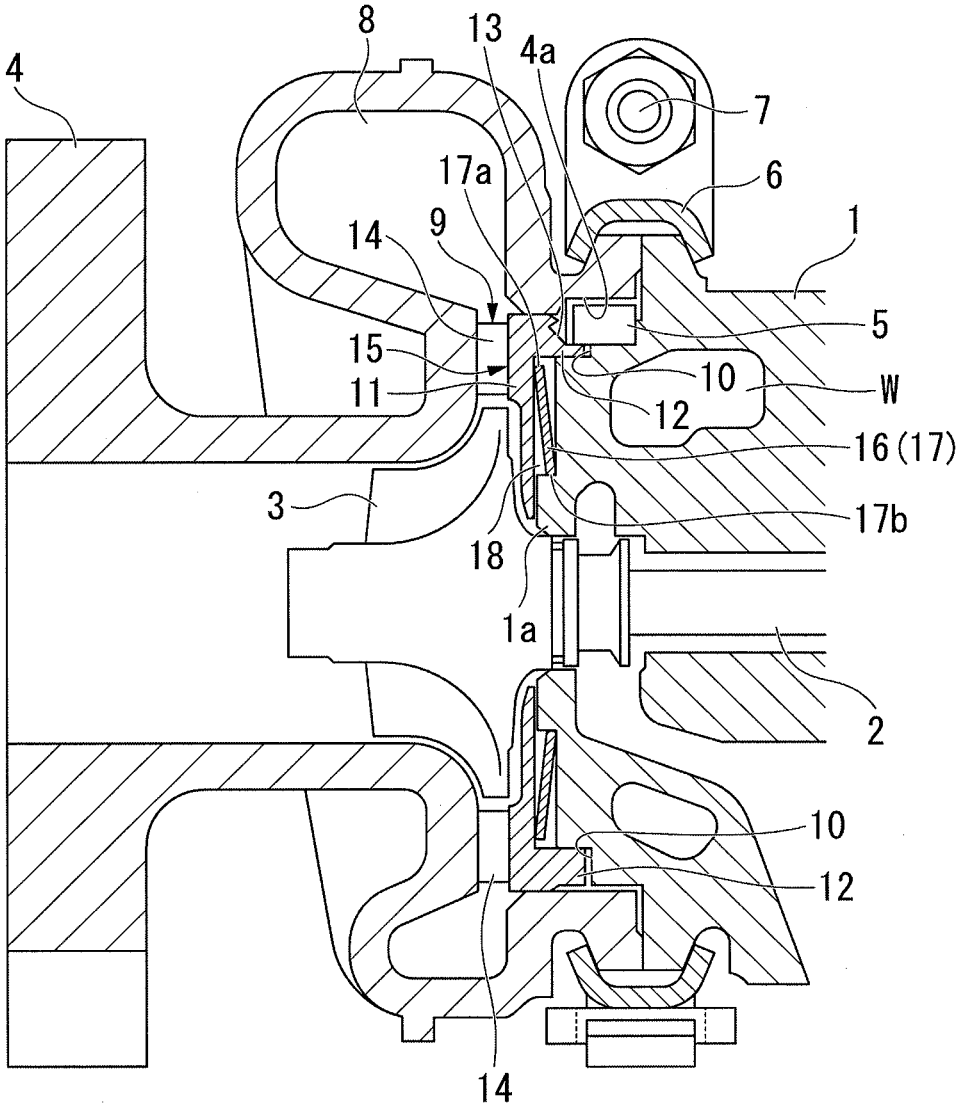
FIG. 1 is a lateral cross-sectional view of essential parts which shows an embodiment of the fixed vane-type turbocharger of the present invention.

FIG. 1 is a drawing which shows an embodiment of the fixed vane-type turbocharger of the present invention, and is a lateral cross-sectional view of essential parts of a fixed vane-type turbocharger provided with a fixed vane in a conduit on the turbine side. This fixed vane-type turbocharger is provided with a fixed vane 15 on a bearing housing 1 side of a conduit 9 that is formed between the mutually opposing front faces (hereinafter sometimes referred to as "opposing front face(s)") of the bearing housing 1 (first member) and a turbine housing 4 (second member).

In this fixed vane-type turbocharger, a turbine impeller 3 is fixed to one end of a rotary shaft 2 which is rotatably supported by the bearing housing 1. In this fixed vane-type turbocharger, positioning in the circumferential direction (the direction of rotation) is conducted by aligning a positioning step 4*a* formed on the front face side of the turbine housing 4 opposite the bearing housing 1 with a positioning pin 5 on the front face side of the bearing housing 1 opposite the turbine housing 4. Subsequently, the bearing housing 1 and the turbine housing 4 are integrally assembled by securing a fastening ring 6 provided at the periphery of the bearing housing 1 and the turbine housing 4 with a fastening bolt 7.

A turbine scroll 8 is formed in the turbine housing 4, and exhaust (fluid) from the turbine scroll 8 is introduced from the peripheral direction into the turbine impeller 3 through the conduit 9 between the respectively opposed front faces of the bearing housing 1 and the turbine housing 4.

Figure 5:
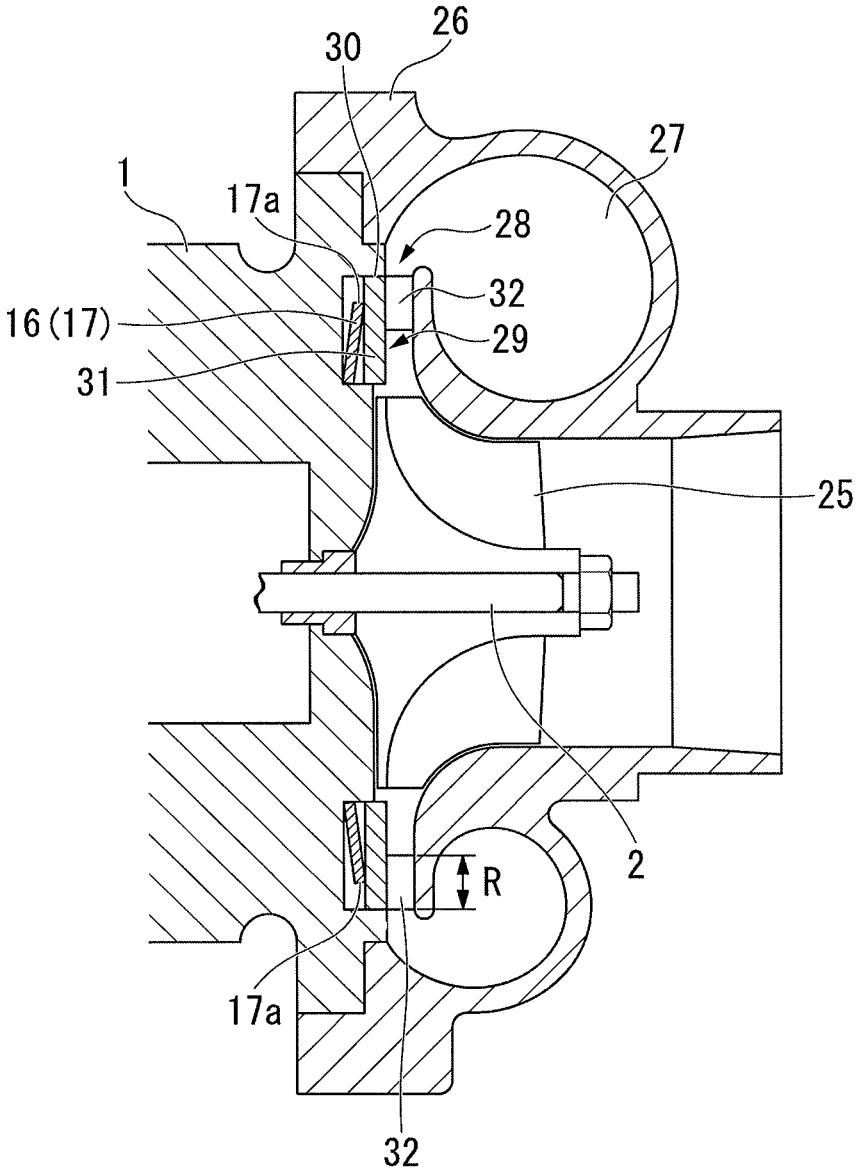
FIG. 5 is a lateral cross-sectional view of essential parts which shows another embodiment of the fixed vane-type turbocharger of the present invention.

A compressor impeller 25 shown in FIG. 5 is provided at the other end of the aforementioned rotary shaft 2. A compressor housing 26 in which a compressor scroll 27 is formed is provided at the periphery of this compressor impeller 25, and the bearing housing 1 and the compressor housing 26 are integrally assembled by forming a conduit 28 between the respectively opposed front faces.

As shown in FIG. 1, an annular fitting groove 10 is formed in the opposing front face of the bearing housing 1 (first member), and a ring-shaped (annular) movable member 11 is provided in this fitting groove 10 so as to be capable of moving forward and backward (in the axial direction). Specifically, the movable member 11 is made capable of forward and backward movement by forming a circular projection 12 in a projecting state at the periphery of the rear face of the movable member 11, and by having this circular projection 12 removably fit into the fitting groove 10. In addition, a recess 13 is formed in the circular projection 12, and this recess 13 engages with the positioning pin 5, thereby regulating movement of the movable member 11 in the circumferential direction.

Figure 2:
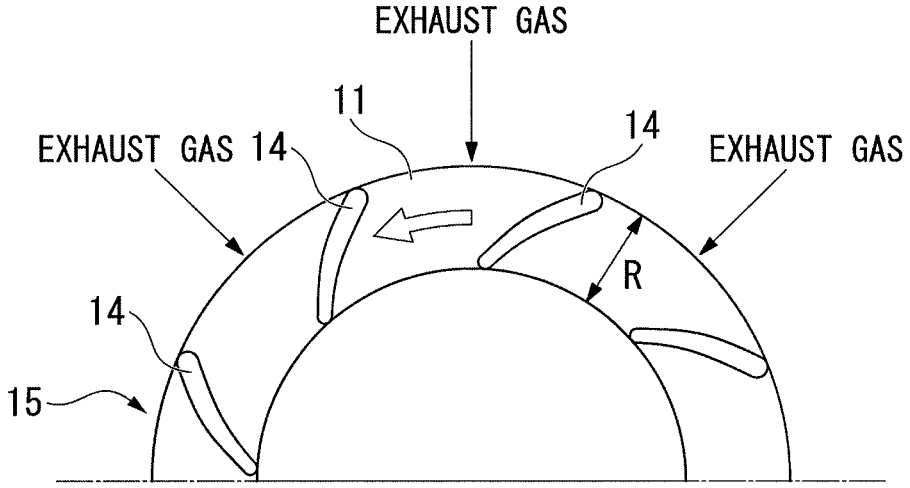
FIG. 2 is a drawing of essential parts of a front face of a movable member.

Proximal ends of multiple vanes 14 are fixed to the front face of the movable member 11, and the fixed vane 15 is configured from the movable member 11 and the vanes 14. Specifically, the vanes 14 are arranged so that their distal ends oppose the opposing front face of the turbine housing 4. Here, as shown in FIG. 2, the vanes 14 are arranged at prescribed intervals in the circumferential direction on the front face of the ring-shaped movable member 11, and by design, are fixed to slant in the same direction as the rotational direction (the direction shown by the arrows in FIG. 2) of the turbine impeller 3. In addition, the movable member 11 also functions as a heat shield plate which inhibits propagation of heat from the high-temperature turbine housing 4 side to the bearing housing 1 side that has a relatively low temperature due to cooling. That is, the movable member 11 is a member which doubles as a heat shield plate.

In a space 18 between the rear face of the movable member 11 (the right-side face in FIG. 1) and the opposing front face of the bearing housing 1, a pressing means 16 is provided which presses the movable member 11, and brings the distal ends of its vanes 14 into pressure contact with opposing front face of the turbine housing 4.

Figure 3A:
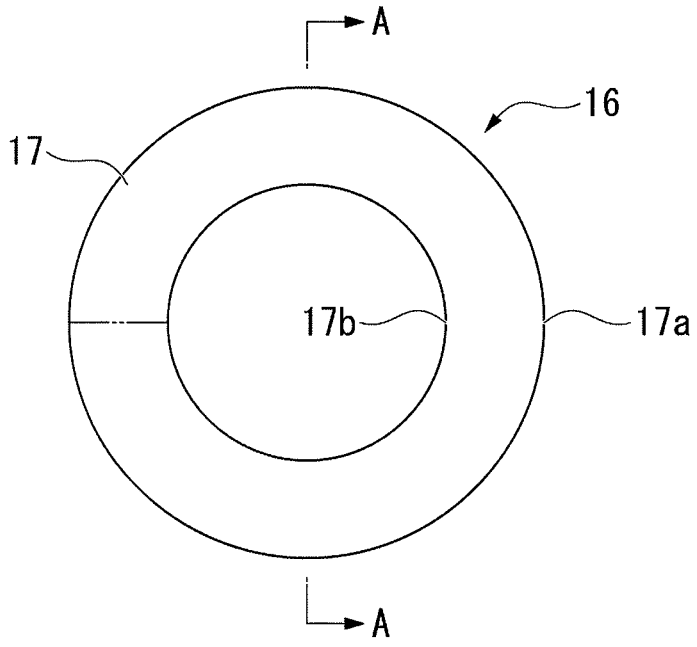
FIG. 3A is a front view which shows an example of a disk spring which is a pressing means.
Figure 3B:
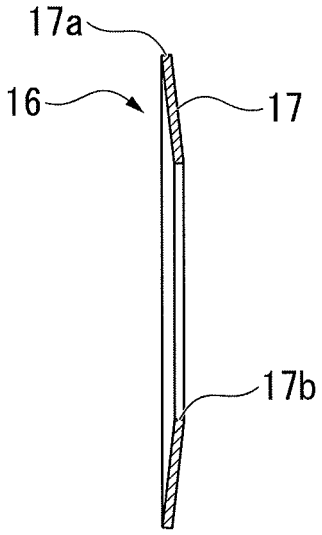
FIG. 3B is a cross-sectional view in the direction of the arrow along line A-A of FIG. 3A.

A disk spring 17 of conical shape (truncated conical shape) with a clipped head section is used as this pressing means 16, as shown in FIG. 1, FIG. 3A, and FIG. 3B of the present embodiment.

This disk spring 17 may have a ring shape as shown in FIG. 3A, or a portion of the ring may be cut out as shown by the double-dotted line. In the present embodiment, using such a disk spring 17, the outer edge—i.e., outer peripheral edge 17*a*—of the disk spring 17 contacts the rear face of the movable member 11, and the inner edge—i.e., inner peripheral edge 17*b*—of the disk spring 17 contacts the opposing front face of the bearing housing 1.

In such a configuration, the disk spring 17 manifests its spring properties with the inner peripheral edge 17*b* that contacts the opposing front face of the bearing housing 1 serving as the fixed side, and the outer peripheral edge 17*a* serving as the movable side, thereby pressing the movable member 11 frontwards, i.e., toward the opposing front face side of the turbine housing 4. By pressing the movable member 11 in this manner, the disk spring 17 (pressing means 16) brings the distal ends of the vanes 14 into pressure contact with the opposing front face of the turbine housing 4, rendering the side clearance between the vanes 14 and the opposing front face of the turbine housing 4 approximately zero, i.e., enabling zero clearance.

Here, the disk spring 17 is fitted from the exterior into a cylindrical salient 1*a* formed on the opposing front face of the bearing housing 1, and is positioned. Specifically, the inner diameter of the disk spring 17 is formed with a diameter larger than that of the salient 1*a* to the extent of the clearance portion, whereby its position is fixed by fitting it from the exterior into the salient 1*a*. Fixing the position of the disk spring 17 in this manner also determines the position of the outer circumferential edge 17*a* that contacts the movable member 11 configuring the fixed vane 15, and that presses against it.

Figure 4A:
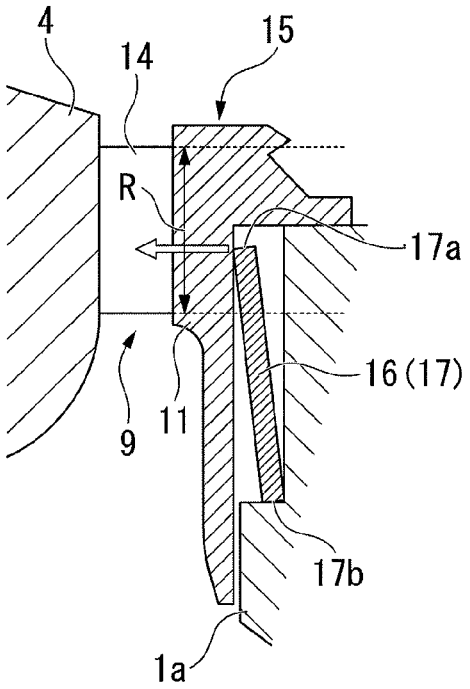
FIG. 4A is a drawing which serves to explain the range in which the disk spring (pressing means) presses the movable member.

In the present embodiment, the site where the outer circumferential edge 17*a* of the disk spring 17 (the pressing means 16) contacts the rear face of the movable member 11—i.e., the site where it presses the movable member 11—is positioned within a range R (see FIG. 2) in the radial direction in which the vanes 14 are disposed as shown in FIG. 4A, and the movable member 11 is pressed within this range R. In the case where the pressing portion of the disk spring 17 relative to the movable member 11 is a "line" as in the present embodiment, the outer circumferential edge 17*a* preferably presses a circle corresponding to the center-of-gravity positions of the vanes 14 or its vicinity. Bringing the outer circumferential edge 17*a* of the disk spring 17 (pressing means 16) into contact with the movable member 11 within the range R in this manner can be easily accomplished by suitably selecting the dimensions (particularly the outer diameter) of the disk spring 17 in advance.

By having the disk spring 17 (pressing means 16) press the movable member 11 within the range R in the radial direction in which the vanes 14 are disposed in this manner, the vanes 14 are not pressed unevenly, and no moment is imposed. Accordingly, it is possible to prevent the vanes 14 from coming into pressure contact in a tilted state against the opposing front face of the opposing turbine housing as shown, for example, in FIG. 4B and FIG. 4C.

Figure 4B:
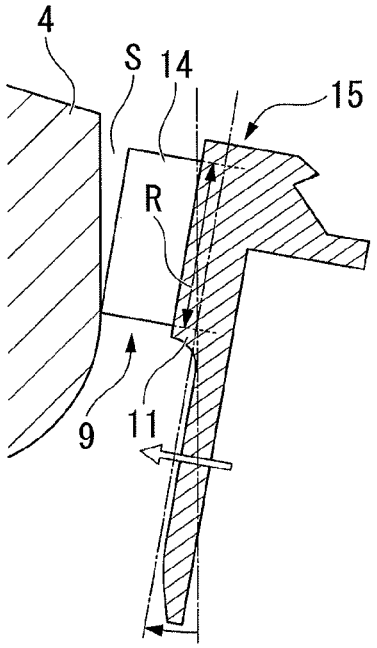
FIG. 4B is a drawing which shows a state in which the disk spring (pressing means) presses the movable member in a tilted state.
Figure 4C:
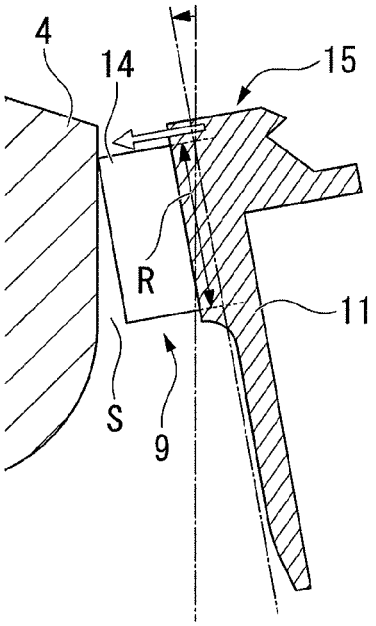
FIG. 4C is a drawing which shows a state in which the disk spring (pressing means) presses the movable member in a tilted state.

Here, FIG. 4B is a drawing which shows an example of the case where the movable member 11 is pressed more toward the inner side (inner peripheral side) than the aforementioned range R, and FIG. 4C is a drawing which shows an example of the case where the movable member 11 is pressed more toward the outer side (outer peripheral side) than the aforementioned range R. As shown in FIG. 4B and FIG. 4C, when the rear face of the movable member 11 is pressed at a position that deviates from the aforementioned range R, the vanes are pressed unevenly, and a moment is imposed on the fixed vane 15, tilting the fixed vane 15. As a result, the vanes 14 may come into pressure contact in a tilted state with the opposing front face of the opposing turbine housing 4.

Specifically, in the case where the movable member 11 is pressed more toward the inner side than the range R as shown in FIG. 4B, a clearance S is formed particularly on the outer side in the radial direction between the vanes 14 and the opposing front face of the turbine housing 4. In the case where the movable member 11 is pressed more toward the outer side than the range R as shown in FIG. 4C, a clearance S is formed particularly on the inner side in the radial direction between the vanes 14 and the opposing front face of the turbine housing 4. When a clearance occurs in this manner between the opposing front face and the front faces of the vanes 14, it is consequently impossible to have a zero side clearance between the vanes 14 and the opposing front face of the turbine housing 4.

In contrast, with the present embodiment, the movable member 11 is pressed within the aforementioned range R as shown in FIG. 4A, with the result that the vanes 14 are not pressed unevenly, and no moment is imposed on the fixed vane 15, and consequently the vanes 14 are brought into pressure contact against the opposing front face of the opposing turbine housing 4 without tilting as described above.

Figure 4D:
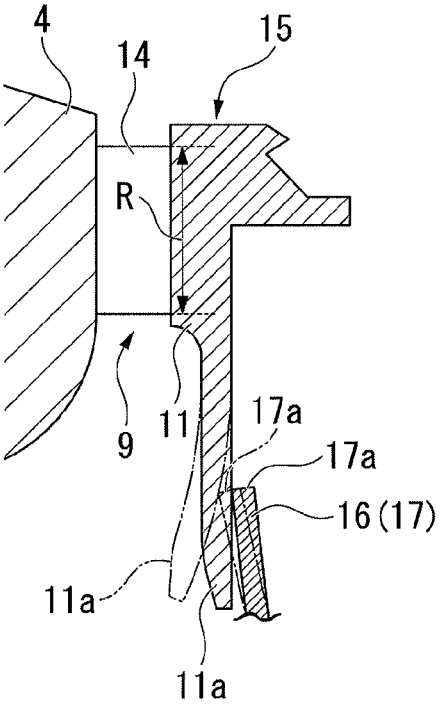
FIG. 4D is a drawing which serves to explain deformation of a thin-walled portion of the movable member.

In the case where the vanes 14 (fixed vane 15) are provided in a conduit 9 on the turbine side as in the present embodiment, the fixed vane 15 sustains major thermal effects from the high-temperature turbine in particular. Therefore, for example, when there is a thin-walled portion 11*a* in the movable member 11 as shown in FIG. 4D, in the case where the outer peripheral edge 17*a* of the disk spring 17 contacts this thin portion 11*a*, and pressing force is imposed, this thin portion 11*a* may experience bending and deformation as shown by the double-dotted line in FIG. 4D.

In contrast, with the present embodiment, it is also possible to prevent deformation of this type of thin portion 11*a* by conducting pressing within the aforementioned range R as shown in FIG. 4A.

By the exercise of such pressing force, the inner peripheral edge 17*b* of the disk spring 17 air-tightly contacts the opposing front face of the bearing housing 1, and the outer peripheral edge 17*a* air-tightly contacts the rear face of the movable member 11. According to this configuration, the disk spring 17 also functions as a sealing member which conducts sealing between the rear face of the movable member 11 and the opposing front face of the bearing housing 1, and prevents leakage of the exhaust (fluid) from the turbine scroll 8 to the bearing housing 1 side through the rear face of the movable member 11.

With respect to the pressing position of the disk spring 17 (pressing means 16) against the rear face of the movable member 11, although the center-of-gravity position of the vanes 14 is preferable as stated above, it is difficult to achieve error-free alignment with this center-of-gravity position. In actuality, it is preferable to have the pressing position of the disk spring 17 (pressing means 16) on the inner side from the center in the radial direction in the aforementioned range R.

As the pressing portion (outer peripheral edge 17*a*) of the disk spring 17 is "linear" in this case as well, a slight moment is imposed on the fixed vane 15, the vanes 14 come into pressure contact in a slightly tilted state with the opposing front face of the turbine housing 4, and a slight clearance S is formed between the vanes 14 and the opposing front face of the turbine housing 4. However, by conducting pressing by the disk spring 17 on the inner side from the center in the radial direction, the clearance S is formed on the outer side in the radial direction, as shown in FIG. 4B. When this occurs, as the speed of the fluid (exhaust) on the outer side in the radial direction in the conduit 9 is slower than on the inner side in the radial direction, the amount of fluid leakage from the clearance S is small, and the reduction in turbine efficiency is consequently minimized.

As the pressing means 16, apart from the disk spring 17, one may also use a web washer, coil spring, or the like. In the case where a web washer, coil spring or the like is used, it is also acceptable to provide a sealer such as an O-ring or C-ring to prevent leakage of the exhaust to the bearing housing 1 side through the rear face of the movable member 11. However, in such cases, it goes without saying that the site where the rear face of the movable member 11 is pressed by this pressing means is to be within the aforementioned range R.

In particular, in the case where a member having elasticity forward and backward such as the disk spring 17 is used as the pressing means 16, the force with which the pressing means 16 presses the movable member 11 can be optionally set by regulating this elasticity. Furthermore, as the pressing means 16 is not affected by the flow rate and the like of the exhaust that is fed into the turbine impeller from the turbine scroll, the pressing means 16 can press the movable member 11 with uniform force regardless of the flow rate of exhaust from the turbine scroll.

A water-cooling jacket W (see FIG. 1) may be provided for cooling purposes inside the bearing housing 1. In such cases, the inner peripheral edge 17*b* of the disk spring 17 and the opposing front face of the bearing housing 1 are preferably brought into contact more toward the interior of the bearing housing 1 in the radial direction than the site where the water-cooling jacket W is formed, as shown, for example, in FIG. 1. By bringing the inner peripheral edge 17*b* of the disk spring 17 and the opposing front face of the bearing housing 1 into contact more toward the interior of the bearing housing 1 in the radial direction than the site where the water-cooling jacket W is formed, cooling of the disk spring 17 by the action of the water-cooling jacket W is facilitated, and functional impairment (so-called "settling" or the like) of the disk spring 17 by heat is prevented.

Next, the operations of the fixed vane-type turbocharger with this configuration are described.

To assemble the fixed vane-type turbocharger, first, as shown in FIG. 1, the disk spring 17 is fitted from the outside into the salient 1*a* of the bearing housing 1, and fixed thereto, with orientation of the outer peripheral edge 17*a* toward the exterior, i.e., toward the opposing front face side of the turbine housing 4. In this state, the circular projection 12 of the movable member 11 is fitted into the fitting groove 10 provided in the opposing front face of the bearing housing 1, whereby the outer peripheral edge 17*a* of the disk spring 17 is brought into contact with the rear face of the movable member 11. In this regard, by suitably selecting for use the dimensions (size) of the disk spring 17 in advance, the outer peripheral edge 17*a* of the disk spring 17 can be brought into contact with the rear face of the movable member 11 within the aforementioned range R.

At this time, the movable member 11 is arranged, and is positioned in the circumferential direction (direction of rotation) so that the recess 13 formed in the circular projection 12 aligns with the positioning pin 5.

Furthermore, the turbine housing 4 is arranged, and is positioned in the circumferential direction so that the positioning step 4*a* formed in the opposing front face of the turbine housing 4 aligns with the positioning pin 5, after which the fastening ring 6 provided at the outer periphery is secured with the fastening bolt 7 to integrally assemble the bearing housing 1 and the turbine housing 4.

According to this assembly, the disk spring 17 disposed at the rear face of the movable member 11 undergoes elastic deformation (compressive deformation), whereby the fixed vane 15 is sandwiched between the bearing housing 1 and the turbine housing 4.

At this time, as the disk spring 17 exerts an elastic return force that effects elastic return from a state of elastic deformation, the movable member 11 (fixed vane 15) is constantly pressed against the turbine housing 4 side by the disk spring 17. Accordingly, the distal ends of the vanes 14 of the fixed vane 15 are constantly in pressure contact with the opposing front face of the turbine housing 4, and the side clearance of the vanes 14 is consequently zero.

As a result, with the fixed vane-type turbocharger of the present embodiment, leakage of exhaust (fluid) from a side clearance can be prevented, thereby enabling a major increase in turbine efficiency.

Moreover, by configuring the pressing means 16 with a disk spring 17, leakage of exhaust to the rear face side of the movable member 11 can be simultaneously prevented as stated above.

Furthermore, by having the movable member 11 double as a heat shield plate, propagation of heat from the turbine housing 4 side to the bearing housing 1 side can be inhibited by this movable member 11.

With respect to the fixed vane-type turbocharger of the present embodiment, a description was given of the case where the proximal ends of the vanes 14 are fixed to the opposing front face of the bearing housing 1 to constitute the fixed vane 15, but it is also acceptable to provide a fixed vane on the turbine housing 4 side, and to bring the distal ends of its vanes into pressure contact with the opposing front face of the bearing housing 1. Specifically, it is also acceptable to pressure bond the distal ends of the vanes 14 against the front face of the movable member 11 provided on the opposing front face of the bearing housing 1 by fixing the vanes 14 to the opposing front face of the turbine housing 4, and by the action of the pressing means 16 that presses the movable member 11 forward. Vanes 14 fixed to the opposing front face of the bearing housing 1 and vanes 14 fixed to the opposing front face of the turbine housing 4 may also be combined in the same turbocharger.

FIG. 5 is a drawing which shows another embodiment of the fixed vane-type turbocharger of the present invention, and is a lateral cross-sectional view of essential parts of a fixed vane-type turbocharger provided with a fixed vane in a conduit on the compressor side.

This fixed vane-type turbocharger has a compressor impeller 25 which integrally rotates with the turbine impeller 3 supported by the bearing housing 1, a compressor housing 26 which is formed so as to surround the compressor impeller 25, and a compressor scroll 27 which is provided in the compressor housing 26. A conduit 28 is formed between the mutually opposing front faces (hereinafter sometimes referred to as "opposing front face(s)") of the aforementioned bearing housing 1 (first member) and the compressor housing 26 (second member), and a fixed vane 29 is provided on the bearing housing 1 (first member) side of this conduit 28.

Specifically, in the present embodiment, a circular groove 30 is formed at a position corresponding to the conduit 28 at the outlet of the compressor housing 26 in the opposing front face of the bearing housing 1 (first member), and a fixed vane 29 is configured by fitting a ring-shaped (annular) movable member 31 provided with vanes 32 on the front face on the conduit 28 side into the groove 30 in a manner enabling forward and backward movement.

The disk spring 17 (pressing means 16) is arranged between the rear face of the movable member 31 (the left side of the page of FIG. 5) in the bottom face of the groove 30. The disk spring 17 presses the rear face of the movable member 31, bringing the distal ends of the vanes 32 into pressure contact with the opposing front face of the compressor housing 26. In the present embodiment, the outer peripheral edge 17*a* of the disk spring 17 contacts the rear face of the movable member 31, and the inner peripheral edge 17*b* of the disk spring 17 contacts the bottom face (opposing front face) of the groove 30 of the bearing housing 1.

Furthermore, in the present embodiment, the site where the outer peripheral edge 17*a* of the disk spring 17 (pressing means 16) contacts the rear face of the movable member 31—i.e., the site where the movable member 31 is pressed—is within the range R in the radial direction in which the vanes 32 are disposed, as in the case shown in FIG. 2 and FIG. 4A.

The disk spring 17 is arranged in the groove 30 formed in the opposing front face of the bearing housing 1. Consequently, positioning of the disk spring 17 is conducted by, for example, having the inner peripheral edge 17*b* side or outer peripheral edge 17*a* side of the disk spring 17 engage with the inner wall face or outer wall face of the groove 30.

Accordingly, with respect also to this fixed vane-type turbocharger, the side clearance between the vanes 32 and the opposing front face of the compressor housing 26 can be kept at zero, thereby enabling prevention of air (fluid) leakage from a side clearance, and greatly raising turbine efficiency.

By configuring the pressing means 16 with the disk spring 17, leakage of exhaust to the rear face side of the movable member 31 can be simultaneously prevented as stated above.

With the fixed vane-type turbocharger of the present embodiment, a description was given of the case where the fixed vane 29 is provided on the opposing front face of the bearing housing 1, but it is also acceptable to provide the fixed vane on the compressor housing 26 side, and to bring the distal ends of its vanes into pressure contact with the opposing front face of the bearing housing 1. Specifically, it is also acceptable to pressure bond the distal ends of the vanes 32 against the front face of the movable member 11 provided on the opposing front face of the bearing housing 1 by fixing the vanes 32 to the opposing front face of the compressor housing 26, and by the action of the pressing means 16 that presses the movable member 31 backward. Vanes 32 fixed to the opposing front face of the bearing housing 1 and vanes 32 fixed to the opposing front face of the compressor housing 26 may also be combined in the same turbocharger.

Preferred embodiments of the present invention have been described above with reference to drawings, but the present invention is not limited by the aforementioned embodiments, and various modifications based on design requirements and the like are possible within a scope that does not deviate from the intent of the present invention.

For example, in the foregoing embodiments, positioning of the disk spring 17 is carried out by fitting it from the exterior into the salient 1*a* of the bearing housing, and accommodating it inside the groove 30. However, it is also acceptable, for example, to use a suitable guide member, and to conduct positioning and fixing of the disk spring 17 using this guide member, setting the position at which the movable member 11 or 31 is pressed by the disk spring 17 within the aforementioned range R on the rear face of the movable member 11 or 31.

INDUSTRIAL APPLICABILITY

As described above, according to the present invention, it is possible to offer a fixed vane-type turbocharger which more reliably enables zero side clearance of vanes by a simple configuration.

DESCRIPTION OF THE REFERENCE NUMERALS

1: bearing housing (first member), 4: turbine housing (second member), 9: conduit, 11: movable member, 14: vane, 15: fixed vane, 16: pressing means, 17: disk spring (pressing means), 17*a*: outer peripheral edge, 17*b*: inner peripheral edge, 26: compressor housing (second member), 28: conduit, 29: fixed vane, 31: movable member, 32: vane

The invention claimed is:

1. A fixed vane-type turbocharger comprising:

a bearing housing having a first face;

a turbine housing connected to the bearing housing via a first conduit;

a compressor housing connected to the bearing housing via a second conduit;

a fixed vane provided in at least one of the first and second conduits, and including:

a ring-shaped member comprising a first face facing the first face of the bearing housing and a second face opposed to the first face and configured to move forward and backward, and vanes fixed to the second face of the ring-shaped member; and a disk spring positioned between the first face of the ring-shaped member and the first face of the bearing housing, and the disk spring configured to press the ring-shaped member by pressing force of the disk spring such that distal ends of the vanes are brought into pressure contact with at least one of a face of the turbine housing and the compressor housing facing the vanes, wherein the disk spring is configured to contact the first face of the ring-shaped member within a range in a radial direction where the vanes are disposed so that the distal ends of the vanes are brought into pressure contact with at least one of the face of the turbine housing and the compressor housing facing the vanes within the range in the radial direction where the vanes are disposed, wherein the disk spring seals off fluid leakage to the bearing housing through the first surface of the ring-shaped member, wherein the disk spring is of a truncated conical shape, wherein an outer peripheral edge of the disk spring contacts the first face of the ring-shaped member, and an inner peripheral edge of the disk spring contacts the first face of the bearing housing, and wherein a site where the outer circumferential edge of the disk spring contacts the first face of the ring-shaped member is positioned within the range in the radial direction where the vanes are disposed, and the outer circumferential edge presses a circle corresponding to positions of centers of gravity of each of the vanes.

2. The fixed vane-type turbocharger according to claim 1, wherein the ring-shaped member is made of a heat shield plate.

3. The fixed vane-type turbocharger according to claim 1, further comprising:

a water-cooling jacket for cooling provided inside the bearing housing, wherein an inner peripheral edge of the disk spring contacts with a front face of the bearing housing in a position more toward an interior of the bearing housing in the radial direction than a site where the water-cooling jacket is formed.

4. A fixed vane-type turbocharger comprising:

a bearing housing having a first face;

a turbine housing connected to the bearing housing via a first conduit;

a compressor housing connected to the bearing housing via a second conduit;

a ring-shaped member comprising a first face facing the first face of the bearing housing and a second face opposed to the first face and configured to move forward and backward;

vanes fixed to at least one of a face of the turbine housing and the compressor housing facing the second face of the ring-shaped member; and a disk spring positioned between the first face of the ring-shaped member and the first face of the bearing housing, and the disk spring configured to press the ring-shaped member by pressing force of the disk spring such that distal ends of the vanes are brought into pressure contact with the second face of the ring-shaped member, wherein the disk spring is configured to contact the first face of the ring-shaped member within a range in a radial direction where the vanes are disposed so that the distal ends of the vanes are brought into pressure contact with the second face of the ring-shaped member within the range in the radial direction where the vanes are disposed, wherein the disk spring seals off fluid leakage to the bearing housing through the first surface of the ring-shaped member, wherein the disk spring is of a truncated conical shape, wherein an outer peripheral edge of the disk spring contacts the first face of the ring-shaped member, and an inner peripheral edge of the disk spring contacts the first face of the bearing housing, and wherein a site where the outer circumferential edge of the disk spring contacts the first face of the ring-shaped member is positioned within the range in the radial direction where the vanes are disposed, and the outer circumferential edge presses a circle corresponding to positions of centers of gravity of each of the vanes.

5. The fixed vane-type turbocharger according to claim 4, wherein the ring-shaped member is made of a heat shield plate.

6. The fixed vane-type turbocharger according to claim 4, further comprising:

a water-cooling jacket for cooling provided inside the bearing housing, wherein an inner peripheral edge of the disk spring contacts with a front face of the bearing housing in a position more toward an interior of the bearing housing in the radial direction than a site where the water-cooling jacket is formed.

* * * * *